US007951010B2

(12) United States Patent
Müller

(10) Patent No.: US 7,951,010 B2
(45) Date of Patent: May 31, 2011

(54) DEVICE IN A THREAD-FORMING TOOL

(76) Inventor: Hans Müller, Frufällen (SE)

( * ) Notice: Subject to any disclaimer, the term of this patent is extended or adjusted under 35 U.S.C. 154(b) by 541 days.

(21) Appl. No.: 12/105,713

(22) Filed: Apr. 18, 2008

(65) Prior Publication Data

US 2008/0261709 A1 Oct. 23, 2008

(30) Foreign Application Priority Data

Apr. 20, 2007 (SE) ..... 0700966

(51) Int. Cl.
*B21J 13/02* (2006.01)
*B23B 45/04* (2006.01)

(52) U.S. Cl. ..... 470/198; 470/96; 408/130

(58) Field of Classification Search ..... 470/96, 470/99, 100, 103, 198; 408/14, 129, 130, 408/137; 409/280, 282, 283
See application file for complete search history.

(56) References Cited

U.S. PATENT DOCUMENTS 4,273,481 A * 6/1981 Corley et al. ..... 408/14
4,350,212 A * 9/1982 Hirose ..... 173/6
4,553,883 A * 11/1985 Brooks ..... 408/130
4,761,100 A * 8/1988 Maillard ..... 408/1 R
5,348,429 A * 9/1994 Pfister ..... 408/129
5,927,910 A * 7/1999 Fix, Jr. ..... 408/17
6,257,809 B1 * 7/2001 Silken ..... 408/129

* cited by examiner

*Primary Examiner* — Edward Tolan
(74) *Attorney, Agent, or Firm* — Potomac Patent Group PLLC

(57) ABSTRACT

The invention relates to a device (101) to provide helical rotating projection of a thread-forming thread core (102).

Figure 1:
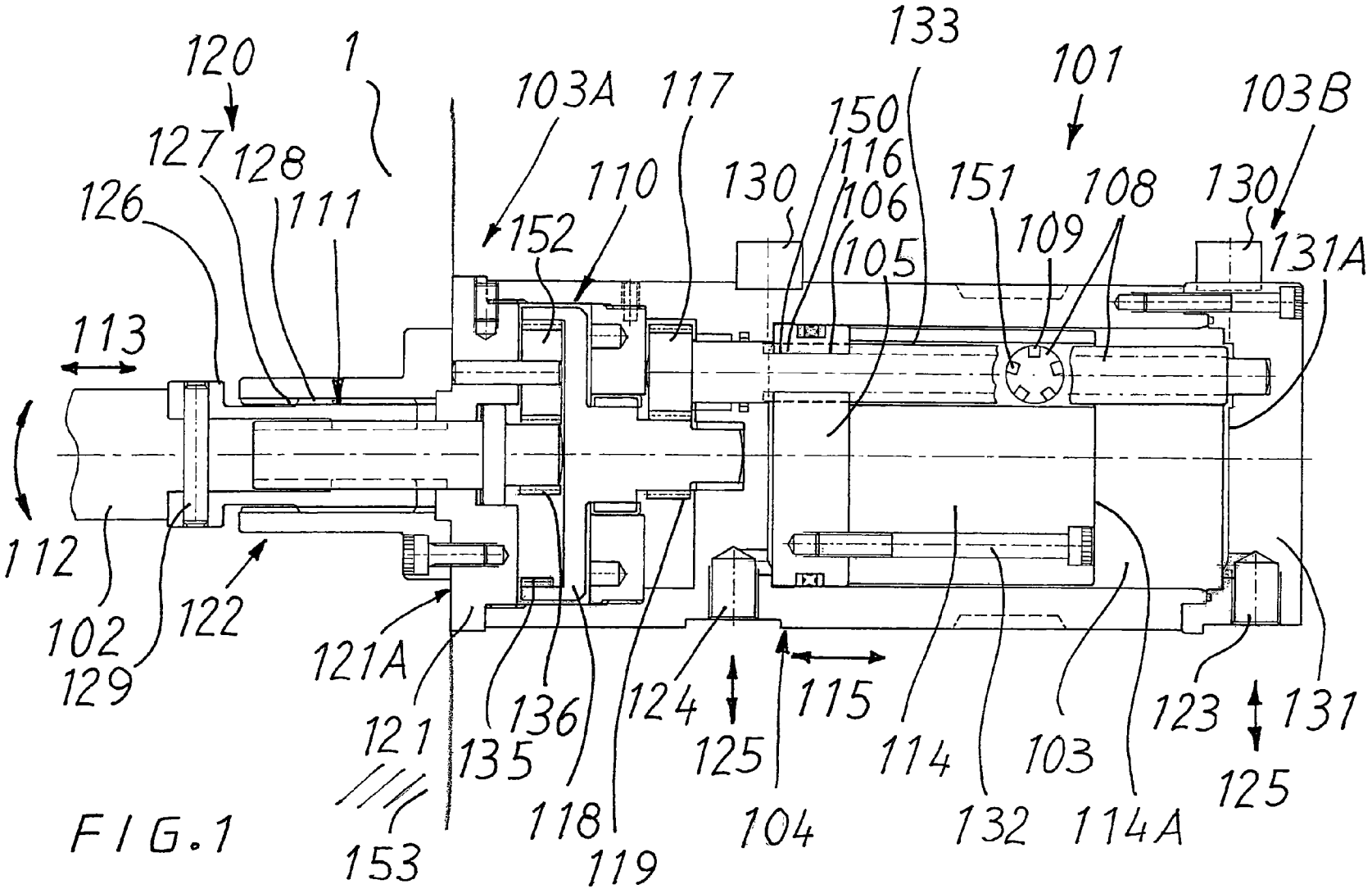

According to the invention, internally in a cylindrical space (103) of a fluid cylinder-piston device (104), there is arranged a movably actuatable piston (105) provided with a number of helical holes (106). In that connection, a helical (109) shaft (108) shape-adapted to the respective hole (106) and helix (107) is receivable in said respective helical hole (106), and that the respective shaft (108) is, via a gear (110), connected with a mechanism (111) for the transmission of rotating (112) as well as axial (113) displacement motion to said thread-formed thread core (102). Finally, a stop member (114), which is arranged to limit the displacement motion (115) of the piston, is arranged internally in the cylinder space (103) of said piston cylinder.

10 Claims, 3 Drawing Sheets

DEVICE IN A THREAD-FORMING TOOL

The present invention relates to a device to provide helical rotating projection of a thread-forming thread core.

Known solutions to produce threads in plastic details are not entirely good since they work with rotation and that the rotation is not so exact to be able to stop the forming machine exactly at a hundredth of a millimeter. When through holes in the plastic detail are concerned, where the thread core has to seal against a steel wall, so that flash does not arise, the customer requires that the thread core exactly repeats into set position. To be 100 percent sure that the core seals, one even works with a small bias of approx. 0.1 mm, so that the thread core is pressed extra hard against the wall.

Therefore, the main object of the present invention is primarily to solve said problem and provide a device that allows to easily provide threads that are exact by simple means.

Said object is attained by means of a device according to the present invention that essentially is characterized in that, internally in a cylindrical space of a fluid cylinder-piston device, there is arranged a movably actuatable piston provided with a number of helical holes, that a helical shaft shape-adapted to the respective hole and helix is receivable in said helical holes, that the respective shaft is, via a gear, connected with a mechanism for the transmission of rotating as well as axial displacement motion to said thread-formed thread core as well as that a stop member, which is arranged to limit the displacement motion of the piston, is arranged internally in the cylinder space of said piston cylinder.

Figure 2:
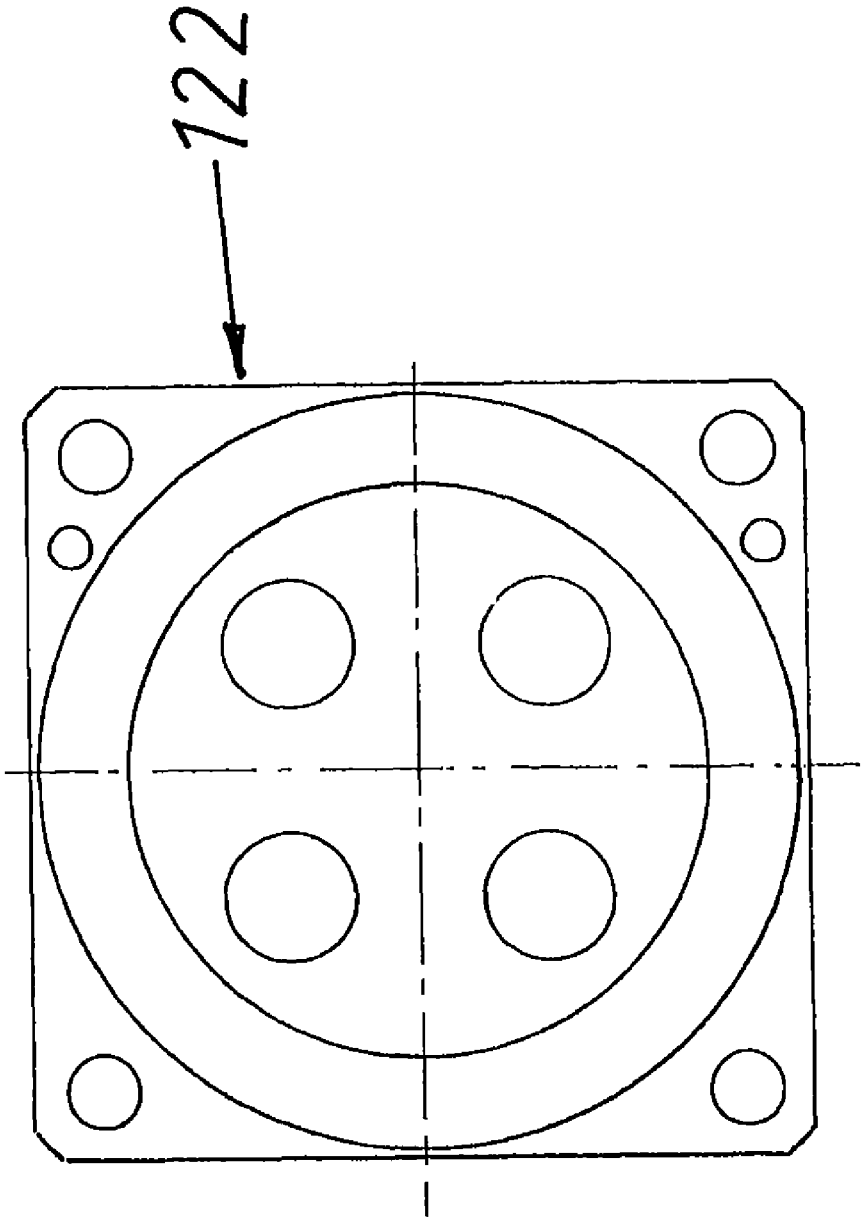
Figure 3:
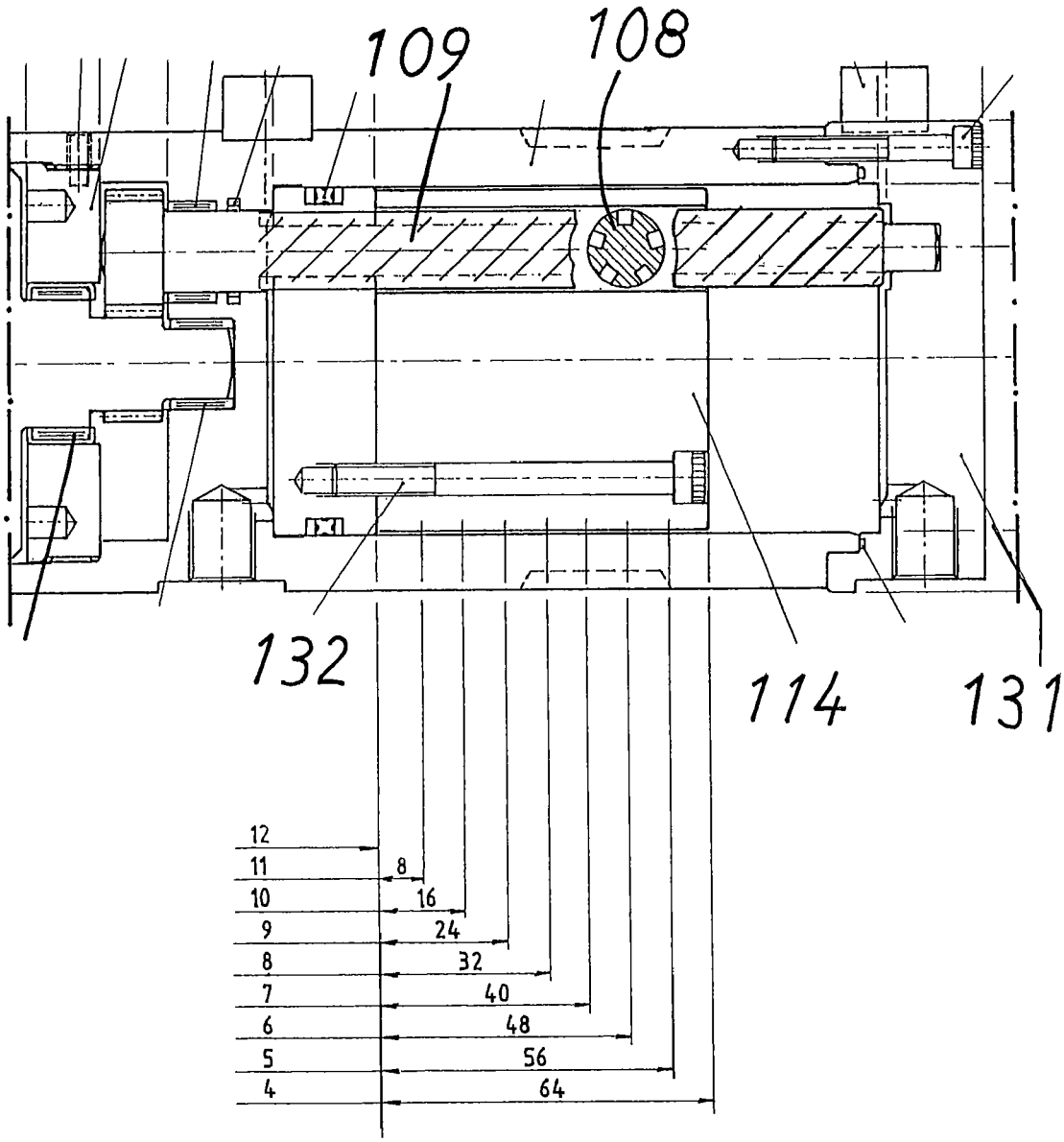

The present invention is described in the following, reference being made to the accompanying drawings, in which FIG. 1 schematically shows a section view of a piston-cylinder device included in the invention, FIG. 2 shows an end portion of said piston-cylinder device, and FIG. 3 shows the function of the piston-cylinder device with different lengths of stop lugs and thread lengths obtained thereby.

Briefly, the invention may be described to be constructed as a hydraulic cylinder device. A piston in the cylinder has a number of helical holes, into which through helical shafts run. Since the shafts have a cogwheel in one end, they drive a planet gear mounted in front. In the shown examples, there is present the following gear change:

The spiral shaft rotates 2.8 turns and the planet gear then increases by 3.5 times.

This results in max 12 turns. When the customer needs a determined number of turns, a stop lug is screwed onto the piston, which determines the exactly desired number of turns.

In this case, a height of 8 mm of the stop lug is one turn of the thread core. On the front side of the cylinder, there are the parts having the leader thread, which easily can be exchanged for different pitches. These parts are worked into the forming plates. A transverse pin couples the thread core to the leader thread. In order for the pin not to fall out, there is an opened resilient ring that lies in a groove. Two elevations on the side of the cylinder are switch housings for inductive switches (the same as on the blocking cylinder having a rocker). The device can be mounted on the side of a forming tool or be attached in one of the attaching plates of the tool. In most cases in the movable half of the mould.

A device 101 according to the invention to provide helical rotating projection of a thread-forming thread core 102 has, internally in a cylindrical space 103 of a fluid cylinder-piston device 104, a movably actuatable piston 105 arranged, said piston 105 being provided with a number of helical holes 106.

In said respective helical hole 106, a helical 109 shaft 108 shape-adapted to the respective hole 106 and helix 107 is receivable.

In that connection, the respective shaft 108 is, via a gear, 110 connected with a mechanism 111 to provide transmission of rotating 112 as well as axial 113 displacement motion to said thread-formed thread core 102. A stop member 114, which is arranged to limit the axial displacement motion 115 of the piston, is arranged internally in the cylinder space 103 of said piston cylinder.

Along the circumference of said piston 105, a plurality of helical holes 106 are arranged uniformly distributed. Said helical holes 106 are arranged to receive a respective helical shaft 108 shape-adapted to said holes 106. Suitably, said holes 106 and the appurtenant received shaft 108 have projecting helical threads 116, 109 and receiving helical grooves 150, 151 mating said threads 116, 109, respectively, along the circumference of said holes 106 and shaft 108, respectively.

In the drawings, an intended gear 110 is shown to be formed of a part of a planet gear having a cogwheel 117 that is fixedly connected with the respective shaft 108 and arranged to rotatably drive a central sun-wheel 118, via an intermediate cogwheel 119, and that is included in said planet gear. Said sun-wheel 118 is in turn arranged to rotatably drive a number of cogwheels 152 included in said formed tool 120.

Externally 121A on one end portion 121 of the piston, a screw-telescope device 122 is received that forms a part of said tool 120. This part is immovably connected with said fluid cylinder device 104 preferably driven by hydraulic fluid. Via inlets and outlets 123, 124, respectively, the fluid 125 is led to and from, respectively, said device 104.

In that connection, the thread core 102 is detachably connected with a sleeve-shaped intermediate part 126 via a threaded joint 127, 128 and that is included in said screw telescope 122. The thread core 102 is connected with said intermediate part 126 by means of a transverse pin 129, and in order for the pin 129 not to fall out, there is arranged an opened resilient ring, not shown, which is lying in a groove.

On the side of the cylinder 104, two or more switch housings 130 are arranged for inductive switches and that are the same as are arranged on the blocking cylinder having a rocker.

Thereby, the device 101 can be mounted on the side of a forming tool 153, such as is shown in the drawings, or also be attached in one of the attaching plates included in the tool, preferably in the movable half of the mould.

According to the invention, the stop member is formed of a stop lug 114 included in a set of stop lugs and detachably attachable to the piston 105 in the cylinder housing 104 or on the cylinder end part 131 by screw 132. Preferably, said stop lug 114 is formed of a part that is screwable onto the piston 105 as well as mutually movable in the cylinder 104 together with the piston 105, and has mating clearance holes 133 for the respective through receivable socket head cap screw 132. The end 114A of the part 114 strikes against the interior cylinder wall surface 131A in the stop position.

In the case shown, 8 mm of said stop part 114 constitutes one turn of the thread core 102 upon the driving thereof using the device 101. By exchanging the stop part according to the table in FIG. 3, the desired number of thread turns is possible to be obtained in a simple and efficient way. On the front side 103A of the cylinder, the parts having the leader thread are located, and as the parts can be exchanged for different pitches of the thread. Said parts are intended to be worked into the forming plates. It is naturally feasible to select other measures than indicated.

The function of the invention should have been understood from the nature of the construction. However, briefly it should be mentioned that when pressurized hydraulic fluid 125 is supplied to the cylinder 104 at the rear end 103B thereof, the piston 105 is actuated to be pushed in the forward direction 134. In that connection, the shafts 108 are actuated to be rotated by thread co-operation. The cogwheels 117 drive the cogwheel 119, which in turn drives the part 118 having the appurtenant internal gear rim 135 with which cogwheels 152 co-operate to be rotated so that the thread core 102 is driven to be rotated in the desired direction 112 for thread-forming in the plastic depending on in which end 104A, 104B fluid 125 is supplied to and discharged from, respectively, the cylinder 104. A number of bearings 136 are arranged.

Naturally, the invention is not limited to the embodiment described above and shown in the accompanying drawings. Modifications are feasible, particularly as for the nature of the different parts, or by using an equivalent technique, without departing from the protection area of the invention, such as it is defined in the claims.

The invention claimed is:

1. A device to provide helical rotating projection of a thread-forming thread core, comprising:

a movably actuatable piston provided with a number of helical holes arranged internally in a cylindrical space of a fluid cylinder-piston device;

a helical shaft shape-adapted to a respective helical hole and receivable in the respective helical hole, wherein the respective shaft is, via a gear, connected with a mechanism for transmitting rotational and axial displacement motion to the thread-forming thread core; and a stop member arranged to limit displacement motion of the piston, wherein the stop member is arranged internally in the cylindrical space of the cylinder-piston device.

2. The device of claim 1, wherein along a circumference of the piston, a plurality of helical holes are arranged uniformly distributed and having helical shafts shape-adapted to the holes.

3. The device of claim 1, wherein the holes and appurtenant received shaft have projecting helical threads and receiving helical grooves mating the threads, respectively, along the circumference of the holes and shaft, respectively.

4. The device of claim 1, wherein the gear is formed of a part of a planet gear.

5. The device of claim 4, wherein a cogwheel, which is fixedly connected with a respective shaft, is arranged to rotatably drive a central sun-wheel that is included in the planet gear and in turn arranged to rotatably drive cogwheels included in a formed tool.

6. The device of claim 5, wherein, externally on one end portion of the piston, a screw-telescope device is received.

7. The device of claim 6, wherein the thread core is detachably connected with a sleeve-shaped intermediate part included in the screw telescope.

8. The device of claim 7, wherein the thread core is connected by a transverse pin.

9. The device of claim 1, wherein the stop member is formed of a stop lug detachably attachable to the piston in the cylinder housing.

10. The device of claim 9, wherein the stop lug is formed of a part that is screwable onto the piston and mutually movable in the cylinder together with the piston, and has clearance holes for the respective screw.

* * * * *